US006129688A

United States Patent [19]

Arkans

[11] Patent Number: 6,129,688

[45] Date of Patent: Oct. 10, 2000

[54] SYSTEM FOR IMPROVING VASCULAR BLOOD FLOW

[75] Inventor: Ed Arkans, Carlsbad, Calif.

[73] Assignee: ACI Medical, San Marcos, Calif.

[21] Appl. No.: 08/706,720

[22] Filed: Sep. 6, 1996

[51] Int. Cl.[7] ..... A61H 9/00

[52] U.S. Cl. ..... 601/152; 601/151

[58] Field of Search ..... 601/148–152

[56] References Cited

U.S. PATENT DOCUMENTS

| | | | |
|---|---|---|---|
| Re. 26,046 | 6/1966 | Gottfried | 128/87 |
| Re. 32,939 | 6/1989 | Gardner et al. | 128/64 |

(List continued on next page.)

FOREIGN PATENT DOCUMENTS

| | | |
|---|---|---|
| 0150553 | 8/1985 | European Pat. Off. . |
| 0221636 | 5/1987 | European Pat. Off. . |
| 2345992 | 10/1977 | France . |
| 2390156 | 12/1978 | France . |
| 2425239 | 12/1979 | France . |
| 2433794 | 1/1976 | Germany . |
| 2716137 | 7/1978 | Germany . |
| 197710 | 10/1977 | U.S.S.R. . |
| 233387 | 5/1925 | United Kingdom . |
| 473639 | 10/1937 | United Kingdom . |
| 479261 | 2/1938 | United Kingdom . |
| 490341 | 8/1938 | United Kingdom . |
| 754883 | 8/1956 | United Kingdom . |
| 813352 | 5/1959 | United Kingdom . |
| 817521 | 7/1959 | United Kingdom . |
| 1310492 | 3/1973 | United Kingdom . |
| 2050174 | 1/1981 | United Kingdom . |
| 2055580 | 3/1981 | United Kingdom . |
| 2077108 | 12/1981 | United Kingdom . |
| 2103489 | 2/1983 | United Kingdom . |
| 2141938 | 1/1985 | United Kingdom . |

OTHER PUBLICATIONS

Rastgeldi, "Pressure Treatment of Peripheral Vascular Diseases, A Short Historical Review" and "Intermittent Pressure Treatment of Peripheral Vascular Diseases, A Survey of Sixteen Years Personal Experience" published in *Opuscula Medica*, Supplementum XXVII 1972, Grundad av Sixten Kallner 1956.

Gardner et al., "The Venous Pump of the Foot–Preliminary Report," published in the Jul. 1983 issue of the *Bristol Medico–Chirurgical Journal* at pp. 109–112.

"Design Fault," published in *Legal Business Magazine*, Oct. 1193, at pp. 44–48.

A.M.N. Gardner and R.H. Fox, "The Return of Blood to the Heart: Venous Pumps in Health and Disease," 1989.

James P. Henry and Travis Winsor, "Compensation of Arterial Insufficiency by Augmenting the Circulation with Intermittent Compression of the Limbs," *American Heart Journal*, Jul. 1965.

*Primary Examiner*—Danton D. DeMille
*Assistant Examiner*—Benjamin K. Koo
*Attorney, Agent, or Firm*—Workman, Nydegger & Seeley

[57] ABSTRACT

A medical apparatus to increase vascular blood flow in the lower extremities of the patient is presented. The medical apparatus is designed to increase vascular blood flow by applying a compressive force to specific regions of the foot, ankle, and/or calf. To achieve this end, the present invention has a foot compression portion and a calf compression portion. The two portions are connected by a severable connection. The severable connection allows the foot portion and calf portion to be used together, or allows the calf portion to be used alone. The foot compression portion is adapted to exert an upward compressive force to the sole of the foot from in front of the heel and extending past the ball of the foot under the phalanges, a downward compressive force in front of the tarsal region of the foot, a downward compressive force in the upper tarsal region of the foot, and a compressive force around the Achilles tendon. The foot compression portion is also adapted to be incapable of applying a downward compressive force in the midtarsal region of the foot. The calf compression portion is designed to apply a compressive force to the dorsal region of the calf.

22 Claims, 4 Drawing Sheets

U.S. PATENT DOCUMENTS

| | | | |
|---|---|---|---|
| Re. 32,940 | 6/1989 | Gardner et al. | 128/64 |
| 1,492,514 | 4/1924 | Jensen . | |
| 1,608,239 | 11/1926 | Rosett . | |
| 2,531,074 | 11/1950 | Miller | 128/38 |
| 2,694,395 | 11/1954 | Brown | 128/38 |
| 2,781,041 | 2/1957 | Weinberg | 128/60 |
| 2,842,655 | 7/1958 | Schwebel | 219/46 |
| 2,880,721 | 4/1959 | Corcoran | 128/39 |
| 2,884,646 | 5/1959 | Alber | 2/232 |
| 3,153,413 | 10/1964 | Gottfried | 128/165 |
| 3,171,410 | 3/1965 | Towle et al. | 128/155 |
| 3,179,106 | 4/1965 | Meredith | 128/24 |
| 3,186,404 | 6/1965 | Gardner | 128/87 |
| 3,286,711 | 11/1966 | Macleod | 128/40 |
| 3,338,237 | 8/1967 | Sconce | 128/87 |
| 3,403,673 | 10/1968 | Macleod | 128/40 |
| 3,450,450 | 6/1969 | Hopkins et al. | 312/1 |
| 3,454,010 | 7/1969 | Lilligren et al. | 128/327 |
| 3,525,333 | 8/1970 | Mencacci | 128/24.2 |
| 3,811,431 | 5/1974 | Apstein | 128/64 |
| 3,824,992 | 7/1974 | Nicholson et al. | 128/24 R |
| 3,826,249 | 7/1974 | Lee et al. | 128/24 R |
| 3,859,989 | 1/1975 | Spielberg | 128/24 R |
| 3,865,102 | 2/1975 | Birtwell et al. | 128/64 |
| 3,865,103 | 2/1975 | Folman | 128/64 |
| 3,888,242 | 6/1975 | Harris et al. | 128/64 |
| 3,892,229 | 7/1975 | Taylor et al. | 128/24 R |
| 3,901,221 | 8/1975 | Nicholson et al. | 128/24 R |
| 3,908,642 | 9/1975 | Vinmont | 128/40 |
| 3,920,006 | 11/1975 | Lapidus | 128/24.1 |
| 3,942,518 | 3/1976 | Tenteris et al. | 128/24 R |
| 3,976,056 | 8/1976 | Brawn | 128/24 R |
| 3,982,531 | 9/1976 | Shaffer | 128/24 R |
| 3,993,053 | 11/1976 | Grossan | 128/64 |
| 4,044,759 | 8/1977 | Ghayouran | 128/24 R |
| 4,054,129 | 10/1977 | Byars et al. | 128/24 R |
| 4,066,084 | 1/1978 | Tillander | 128/327 |
| 4,077,402 | 3/1978 | Benjamin, Jr. et al. | 128/24 R |
| 4,091,804 | 5/1978 | Hasty | 128/24 R |
| 4,153,050 | 5/1979 | Bishop et al. | 128/64 |
| 4,186,732 | 2/1980 | Christoffel | 128/24 R |
| 4,198,961 | 4/1980 | Arkans | 128/24 R |
| 4,202,325 | 5/1980 | Villari et al. | 128/24 R |
| 4,206,751 | 6/1980 | Schneider | 128/24 R |
| 4,207,876 | 6/1980 | Annis | 128/24 R |
| 4,231,355 | 11/1980 | Hara | 128/24.2 |
| 4,269,175 | 5/1981 | Dillon | 128/24 R |
| 4,311,135 | 1/1982 | Brueckner et al. | 128/24 R |
| 4,370,975 | 2/1983 | Wright | 128/64 |
| 4,372,297 | 2/1983 | Perlin | 128/64 |
| 4,374,518 | 2/1983 | VIllanueva | 128/64 |
| 4,388,919 | 6/1983 | Benjamin, Jr. et al. | 128/64 |
| 4,396,010 | 8/1983 | Arkans | 128/24 R |
| 4,402,312 | 9/1983 | Villari et al. | 128/24 R |
| 4,418,690 | 12/1983 | Mummert | 128/24 R |
| 4,453,538 | 6/1984 | Whitney | 128/24 R |
| 4,502,470 | 3/1985 | Kiser et al. | 128/64 |
| 4,577,626 | 3/1986 | Marukawa et al. | 128/64 |
| 4,614,179 | 9/1986 | Gardner et al. | 128/64 |
| 4,614,180 | 9/1986 | Gardner et al. | 128/64 |
| 4,624,244 | 11/1986 | Taheri | 128/24 R |
| 4,696,289 | 9/1987 | Gardner et al. | 128/64 |
| 4,702,232 | 10/1987 | Gardner et al. | 128/64 |
| 4,706,658 | 11/1987 | Cronin | 128/77 |
| 4,709,694 | 12/1987 | O'Connell | 128/87 |
| 4,721,101 | 1/1988 | Gardner et al. | 128/64 |
| 4,841,956 | 6/1989 | Gardner et al. | 128/64 |
| 4,846,160 | 7/1989 | Gardner et al. | 128/64 |
| 4,858,596 | 8/1989 | Kolstedt et al. | 128/24 R |
| 4,938,208 | 7/1990 | Dye | 128/87 R |
| 4,947,834 | 8/1990 | Kartheus et al. | 128/64 |
| 4,989,589 | 2/1991 | Pekanmäki et al. | 128/64 |
| 5,052,377 | 10/1991 | Frajdenrajch | 128/64 |
| 5,092,317 | 3/1992 | Zelikovski | 128/64 |
| 5,218,954 | 6/1993 | Van Bemmelen | 128/24 R |
| 5,354,260 | 10/1994 | Cook | 602/13 |

SYSTEM FOR IMPROVING VASCULAR BLOOD FLOW

BACKGROUND OF THE INVENTION

1. The Field of the Invention

The present invention relates to systems and methods for improving vascular blood flow, and more specifically (A) for improving arterial blood flow in the lower extremities by (a) increasing venous blood flow and (b) enhancing functionality of the vessels with high shear rates through compression of specific portions of the foot, ankle, and calf of a patient, and (B) for reducing the incidence of venous blood clot formation in the lower limbs by creating pulsatile venous flow and promoting venous emptying.

2. The Relevant Technology

Improvement of arterial blood flow in patients with obstructions of the arteries to the leg is usually obtained by surgically bypassing the occluded arteries, or by removing obstructions with devices that are inserted into the blood vessel. In elderly patients who have undergone multiple vascular procedures, the deterioration of arterial blood flow can lead to severe pain (ischemic neuritis), tissue loss (arterial ulcers), or toe loss (gangrene). When the arteries cannot be repaired anymore, this situation may lead to leg amputation.

In order to increase vascular blood flow without surgery, devices are sometimes used which apply a compressive force to various designated areas of the foot or leg. This compressive force is designed to increase the amount of blood returning to the heart through the veins, thereby increasing the arterial blood flow to the extremity. These compressive forces are typically designed to mimic a walking action which helps to push blood through the veins to the heart.

In normal walking, the foot is intermittently weight bearing, a result of which is to flatten the plantar arch. This flattening motion causes a spreading force between the ball and heel of the foot and a squeezing of the sole of the foot. This action produces a foot-pump action that helps to increase the venous blood flow in the leg. Prior art devices have therefore focused on mimicking such a flattening of the plantar arch. This is usually performed by wrapping a bladder completely around the foot between the heel and the ball of the foot. A fluid is then injected into the bladder in order to create a compressive force both on the top and bottom of the foot. Such an approach, however, creates several problems.

Devices that compress the feet of certain sensitive patient groups, such as diabetics, may irritate the skin and ultimately lead to skin breakdown over the bony areas at the midtarsal region. The compression of this midtarsal region thus leads to a situation where compression therapy for a particular class of patients must be limited in duration in order to avoid such tissue breakdown. It would, therefore, be advantageous to allow compression therapy of this class of patients over a longer period of time without breakdown of the skin over the bony areas at the midtarsal region.

In addition to the breakdown of tissue over the midtarsal region for certain groups of patients, prior art devices also are not usable on that portion of the patient population which have abnormally shaped feet. For certain patients, a bladder which completely encircles the foot and extends in a region from about the heel to the ball of the foot will not fit. It would, therefore, be advantageous to allow compression therapy on a wide range of patients including those having abnormal foot shapes.

For certain patients who have extremely sensitive feet, the application of a compressive force on both the top and bottom of the foot can cause tremendous pain. Patients who have had reduced blood flow in the lower extremities for a long period of time are especially susceptible to pain when compression therapy of the foot is initiated. It would, therefore, be advantageous to allow for a treatment regime which gradually increases a patient's tolerance until compression therapy of the foot can be tolerated.

Finally, because the bladder completely encircles the foot, it can be difficult to assess the effectiveness of the treatment or to identify any developing problems. Since the bladder covers almost the entire foot, visual inspection can be difficult. Often to assess the effectiveness and identify developing problems, the treatment must be stopped and the device removed. It would, therefore, represent an advancement in the art to allow increased visual inspection during treatment with little or no impact on the effectiveness of the treatment.

Another problem suffered by patients is deep vein thrombosis. Deep vein thrombosis (DVT) is the formation of thrombus in the deep veins of the lower limb. DVT may follow trauma or surgery and is often associated with activated blood clotting factors and/or very slow blood flow called stasis. External pneumatic compression prevents stasis by two possible mechanism types: (1) a small volume of blood is accelerated to a relatively high velocity for a short period of time, and a large volume of blood is accelerated to a relatively low velocity for a longer period of time. Foot compression devices such as that described by Cook in U.S. Pat. No. 5,354,260 are examples of the first type in that the relatively small foot blood volume is accelerated rapidly to a high velocity. Calf and thigh compression devices such as that described by Hasty in U.S. Pat. No. 4,013,069 are examples of the second type in that a large blood volume in the calf and thigh are accelerated to relatively lower velocities for periods of time that typically exceed that of foot only compression types.

Since foot only compression does not significantly effect flow in some of the large veins in the calf (such as the so-called soleal sinuses where thrombi often originate), calf vein thrombi are still a large potential problem. Calf and thigh compression may move larger amounts of blood but stasis is better reduced with high blood velocities. It would, therefore, be desirable to be able to both create high blood velocities and move large blood volumes to provide patients with prophylaxis against deep vein thrombosis.

SUMMARY AND OBJECTS OF THE INVENTION

The foregoing problems in the prior state of the art have been successfully overcome by the present invention, which is directed to a system and method for increasing vascular blood flow in the lower extremities. Embodiments within the scope of the present invention may comprise a foot compression portion and a calf compression portion. The foot compression portion is designed to place compressive forces on particular locations of the foot and ankle. For example, embodiments may apply an upward compressive force to the sole of the foot from in front of the heel and extending past the ball of the foot to the phalanges. By extending the compressive force past the ball of the foot to the phalanges, the present invention more closely mimics the bend of the phalanges that occurs during walking.

Embodiments may also apply a downward compressive force in front of the tarsal region and a downward compressive force in the upper tarsal region. In these embodiments, the present invention leaves the midtarsal region open. This design carries several advantages over the prior art. For example, leaving the midtarsal region open allows visual inspection of the skin over the midtarsal region. This allows assessment of the health of the skin tissue by looking at the color and texture of the skin. Skin blood flow can also be assessed by applying sensors such as a laser Doppler flux probe or a photo plethysmographic probe. Finally, an underlying artery can be palpated for pulsatility by hand or by using an electric monitor incorporating a strain sensitive element or continuous wave ultrasonic Doppler probe that is placed on the skin over the artery.

Another advantage of leaving the midtarsal region open is that skin breakdown for sensitive patient groups, such as diabetics, is dramatically reduced thereby allowing for longer term application of compressive therapy. Finally, by placing straps to exert compressive forces only below the tarsal region and in the upper tarsal region, patients with a wide variety of foot shapes, including abnormal foot shapes, can be more readily accommodated.

Embodiments of the present invention may also apply a compressive force around the achilles tendon anywhere in a region bounded essentially by the posterior portion of the calcaneus, the medial malleolus of the tibia, the Achilles tendon, and the posterior portion of the navicular. Applying compressive forces in this region actuates a pump that helps to push blood through the veins toward the heart.

The calf compression portion of the present invention is designed to apply a compressive force to the dorsal side of the calf. The compressive force is preferably a progressive force which starts toward the lower portion of the calf and progresses upward to the upper portion of the calf. The calf compression portion and the foot compression portion may be connected together to facilitate proper placement of the foot compression portion and calf compression portion.

The attachment between the foot compression portion and calf compression portion may also be severable in order to allow use of the calf compression portion apart from the foot compression portion. Such a feature allows a physician to apply calf compression therapy in order to increase the vascular blood flow. By applying calf compression therapy without foot compression therapy, blood flow can be increased in patient groups with extremely sensitive feet. After calf compression therapy has been applied, it may later be desirable to add foot compression therapy. This may be accomplished by simply placing the detached foot compression portion onto the patient for use in conjunction with the calf compression portion.

The compressive forces of both the foot compression portion and calf compression portion are preferably generated by an inflatable bladder enclosed within a retaining structure. The preferred retaining structure is pile material (such as that used by hook and pile fasteners) that encloses the inflatable bladders. Double-sided hook devices may then be used to retain straps at the locations which hold the bladder of the foot compression portion or the bladder of the calf compression portion in place.

The inflatable bladders of the foot compression portion and calf compression portion are preferably separate so that each can be inflated independently. The bladders are preferably filled by a large bore fitting adapter to carry fluid from a fluid source to the appropriate bladder.

The inflation, deflation, and delay rate as well as the pressure are adjustable over a wide range of parameters. Thus, when both the foot and calf inflation portions are used together, they may be inflated either simultaneously or progressively.

It is therefore a primary object of the present invention to provide for a medical device that increases vascular blood flow in the lower extremities that can be used with a wide range of patients, including those in sensitive patient classes.

Another object of the present invention is to provide for a medical device that improves vascular blood flow in the lower extremities that allows visual inspection and monitoring of the midtarsal region of the foot.

Yet another object of the present invention is to provide for a medical device that improves vascular blood flow in the lower extremities that provides compression therapy to the foot and calf, or to the calf alone.

A still further object of the present invention is to provide a medical device that improves vascular blood flow in the lower extremities and that also reduces or eliminates tissue breakdown in the midtarsal region.

Another object of the present invention is to provide a medical device that can be used to treat deep vein thrombosis both by creating high blood velocities and by moving large blood volumes through rapid compression of areas of the foot, ankle, and calf.

Additional objects and advantages of the present invention will be set forth in the description which follows, and in part will be obvious from the description, or may be learned by practice of the invention. The objects and advantages of the present invention may be realized and obtained by means of the instruments and combinations particularly pointed out in the appended claims. These and other objects and features of the present invention will become more fully apparent from the following description and appended claims, or may be learned by practice of the invention as set forth hereinafter.

BRIEF DESCRIPTION OF THE DRAWINGS

In order to illustrate the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 5:
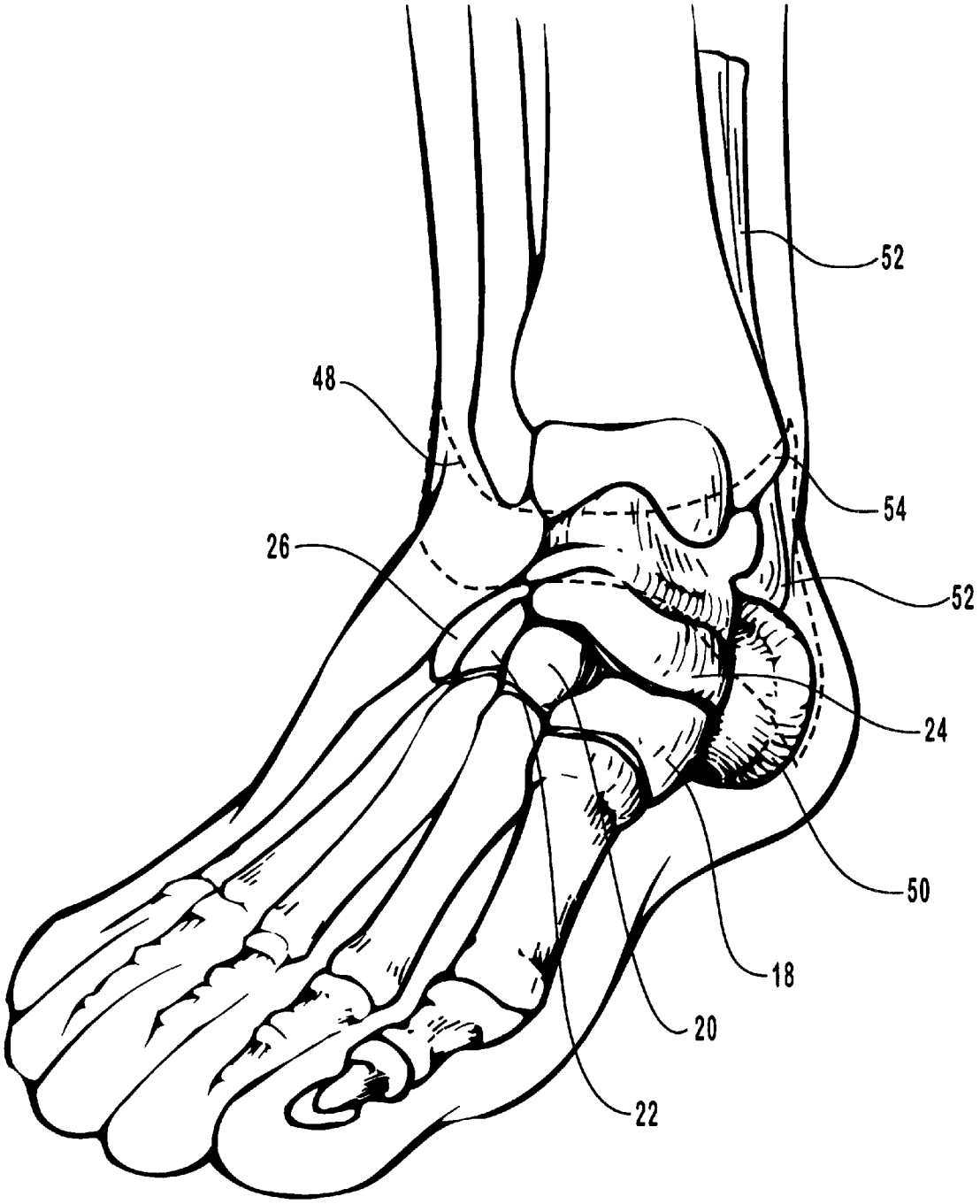
FIG. 5 is a perspective view of the ankle showing the various bones of the ankle.

Throughout the following description, FIG. 5 will be referenced to help identify various bones or regions of the ankle and foot.

Figure 1:
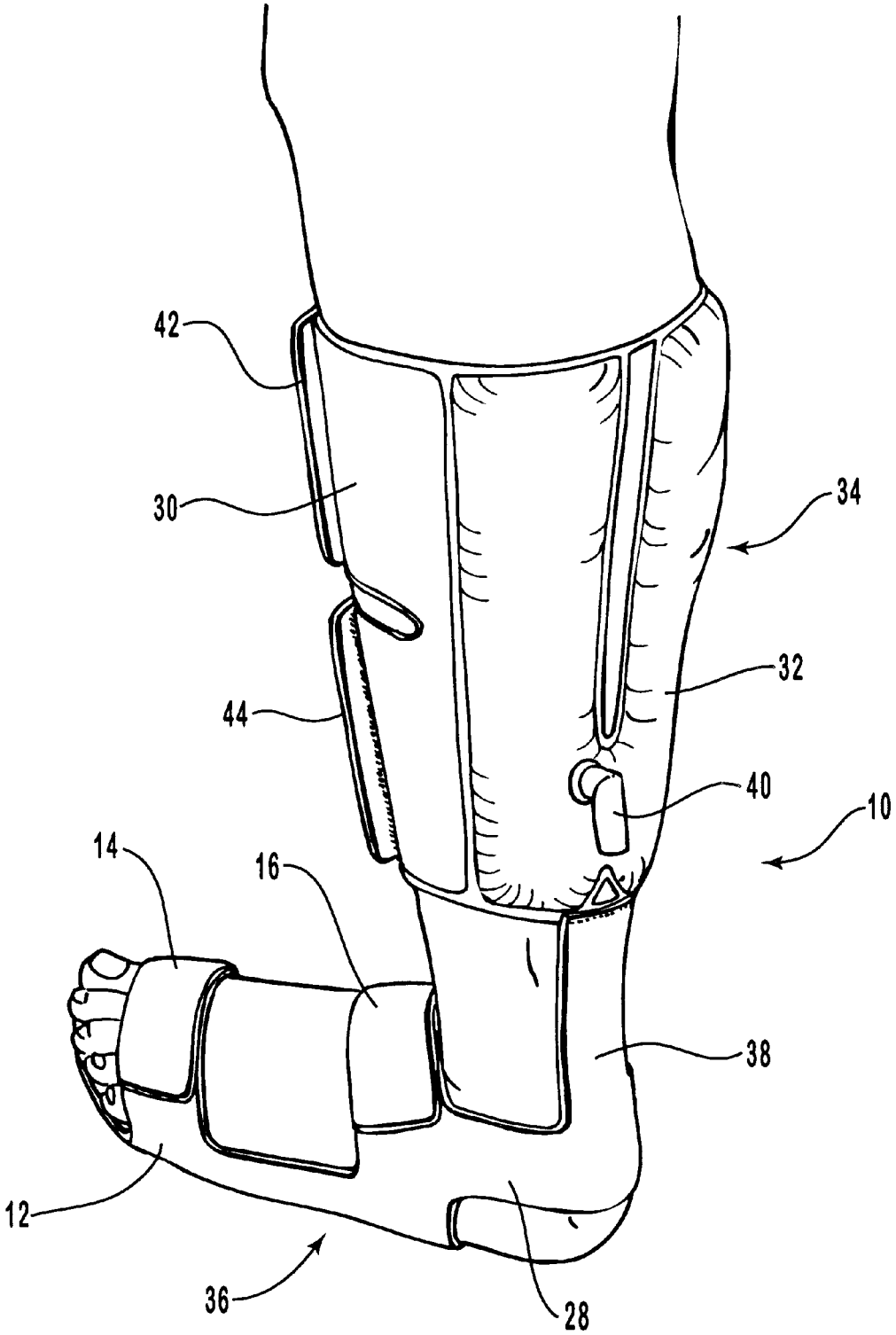
FIG. 1 is a diagram illustrating the calf compression portion and foot compression portion of one embodiment of the present invention.

Referring now to FIG. 1, a perspective view of one embodiment of the present invention is shown generally as 10. This embodiment comprises a foot compression portion shown generally as 36 and a calf compression portion shown generally as 34. The details of these two portions are presented below, but the foot compression portion is designed to apply compressive forces to designated areas of the foot and/or ankle. The calf compression portion is designed to apply compressive forces to designated areas of the calf.

Embodiments within the scope of this invention may comprise compressive means for applying a compressive force to selected portions of a foot when said compressive means is held substantially against the portions of the foot and actuated, and retaining means for retaining the compressive means substantially against the foot. In FIG. 1, such retaining means is illustrated by retaining structure 12. Retaining structure 12 preferably comprises pile material such as that used in hook and pile fasteners like Velcro®. The pile material preferably covers the entire surface of the retaining structure so that the retaining structure can be held in place by double-backed hook closures as described hereafter.

Retaining structure 12 preferably encloses an inflatable bladder. The inflatable bladder is one example of compressive means for applying a compressive force to selected portions of the foot. By tailoring the locations and extent of the bladder within retaining structure 12, the bladder may be held against desired portions of the foot in order to apply a compressive force thereto. In the embodiment illustrated in FIG. 1, retaining structure 12 has one set of straps 14 that can be secured in front of the tarsal region and a second set of straps 16 that can be secured in the upper tarsal region of the foot. Referring briefly to FIG. 5, the midtarsal region is defined as that region across the cuneiforms, namely the first cuneiform 18, the second cuneiform 20, and the third cuneiform 22. The upper tarsal region is generally above the cuneiforms such as across the navicular 24 or the upper portion of the cuboid 26. The phrase "in front of the tarsal region" will be used to generally refer to any region extending distally from the cuneiforms to the end of the toes.

Returning now to FIG. 1, embodiments within the scope of this invention may also have a third strap 28 which extends posteriorly around the Achilles tendon. Straps 14, 16, and 28 help hold retaining structure 12 in a desired location so that the inflatable bladder enclosed with retaining structure 12 will apply compressive forces to the desired portions of the foot and ankle. If the inflatable bladder extends within any or all of these straps, compressive forces can also be exerted in the regions of the foot covered by the straps. Retaining structure 12 along with its enclosed bladder is sometimes referred to as foot compression portion 36. The details of foot compression portion 36 and the design of the bladder and location of the various compressive forces of foot compression portion 36 are described in greater detail below.

Embodiments within the scope of the present invention may also comprise compressive means for applying a compressive force to the dorsal side of the calf and retaining means for retaining this compressive means substantially against the dorsal side of the calf. In FIG. 1, such retaining means is illustrated by retaining structure 30. Retaining structure 30 is preferably constructed, like retaining structure 12, from a pile material like that used in hook and pile fasteners. Retaining structure 30 also preferably encloses the compressive means for applying a compressive force against the dorsal side of the calf. In FIG. 1, such compressive means may comprise, by way of example and not limitation, inflatable bladder 32. Inflatable bladder 32 is preferably completely enclosed by retaining structure 30 so that inflatable bladder 32 can be held substantially against the dorsal side of the calf. When a fluid is forced into inflatable bladder 32, inflatable bladder 32 expands and exerts a compressive force on the appropriate locations of the calf. Retaining structure 30, along with associated inflatable bladder 32 is sometimes referred to as calf compression portion 34.

Figure 2:
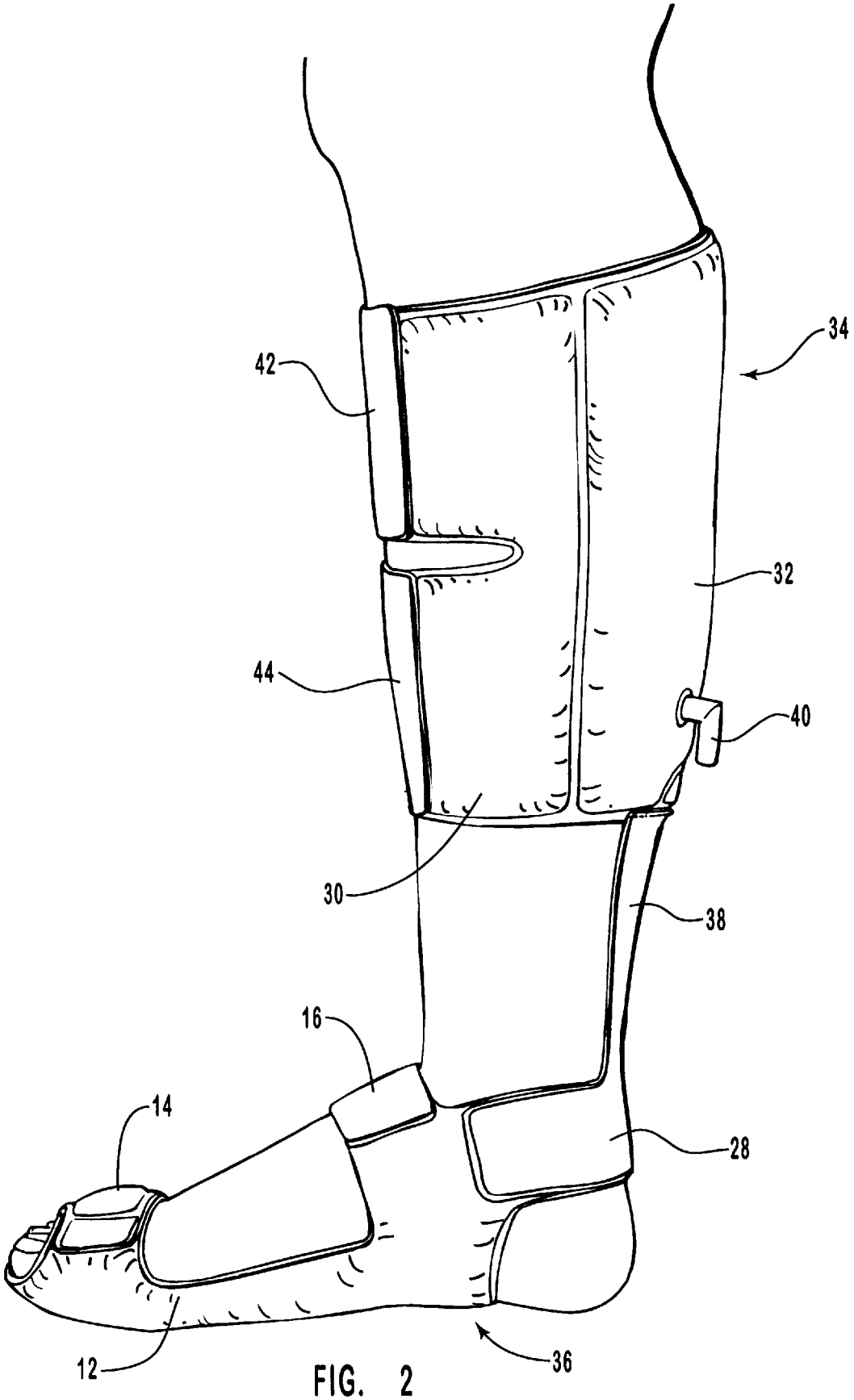
FIG. 2 is a side view of the calf compression portion and foot compression portion of one embodiment of the present invention.

Referring next to FIG. 2, the connection between calf compression portion 34 and foot compression portion 36 is discussed. In order to aid in the positioning of foot compression portion 36 and calf compression portion 34, calf compression portion 34 and foot compression portion 36 may be attached to form a single device. In FIG. 2, calf compression portion 34 and foot compression portion 36 are connected by attachment 38. Attachment 38 may be a strip of material, such as the pile material used for retaining structure 12 and retaining structure 30. Although not required, it is preferred that attachment 38 not contain compressive means such as an inflatable bladder. In this way, it is possible to separate calf compression portion 34 from foot compression portion 36 by cutting through attachment 38. Once the two portions are separated, the calf compression portion may be used independently from the foot compression portion. This may create an advantage over present treatment regimes for individuals suffering from extreme sensitivity in the foot region. For example, for individuals with extreme sensitivity of the foot due to reduced vascular blood flow, the calf compression portion may be applied to the patient and compression therapy initiated. Once the compression therapy has increased the vascular blood flow to the foot, sensitivity to compression of the foot may be reduced to the point that compression therapy of the foot is better tolerated. The foot compression portion, which was severed from the calf compression portion, may then be added to the patient in order to provide a combined foot/calf compression therapy.

When the compression means for applying a compressive force to the dorsal side of the calf is an inflatable bladder, embodiments may comprises filling means for filling the bladder with a fluid from a fluid source. Such filling means may comprise a large bore fitting such as fitting 40 of FIG. 2. By making fitting 40 relatively large bore, the inflation and deflation times may be substantially decreased in order to reach the peak compressive force faster and remove the peak compressive force faster.

As illustrated in FIGS. 1 and 2, fitting 40 may be located in the lower portion of inflatable bladder 32. Locating fitting 40 in the lower portion of inflatable bladder 32 allows a progressive compressive force to be applied to the calf. As bladder 32 fills with a fluid, the compressive force generated by the bladder will be strongest at the bottom and then progress upward toward the top of the calf until the peak compressive force is reached all along the calf. Such a progressive force may help push the blood in the veins toward the heart.

As previously mentioned, retaining structure 12 and retaining structure 30 preferably are made from pile material, such as that used in hook and pile fasteners. Furthermore, it is preferable that all straps, such as straps 14, 16, and 28 of foot compression portion 36 and straps 42 and 44 of calf compression portion 34, also be manufactured from pile material. These straps may then be held in place by a double-sided hook fastener, manufactured from the same hook material as a hook and pile fastener. The double-sided hook fastener has hook material on both sides. This double-sided hook fastener is then placed between a strap and the retaining structure. The double-sided hook material then grabs the pile material of the strap and the pile material of the retaining structure and keeps the strap in place. Using a double-sided hook fastener in this manner reduces the cost of manufacture and provides greater flexibility in adjusting the straps to fit a wider range of patients.

Figure 3:
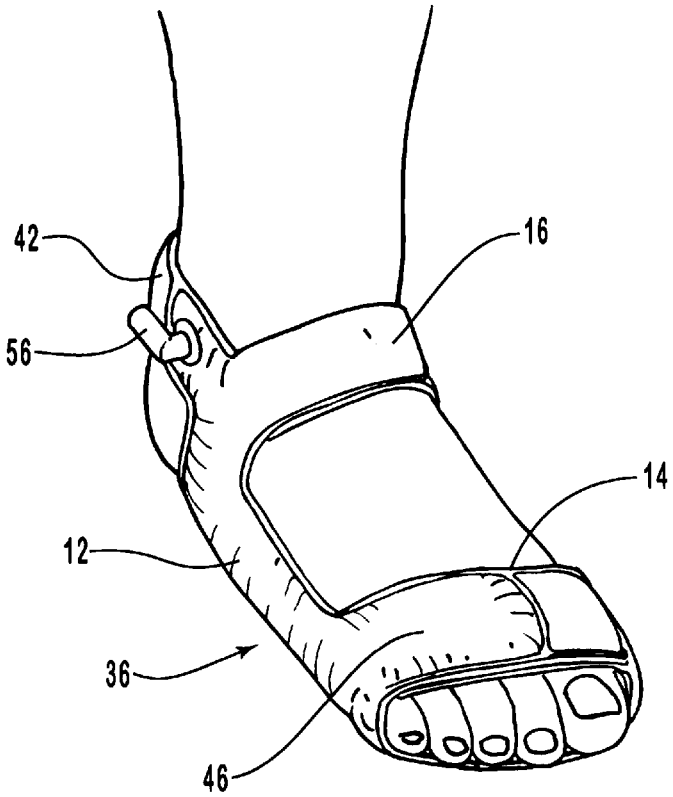
FIG. 3 is a view of the foot compression portion of one embodiment of the present invention.
Figure 4:
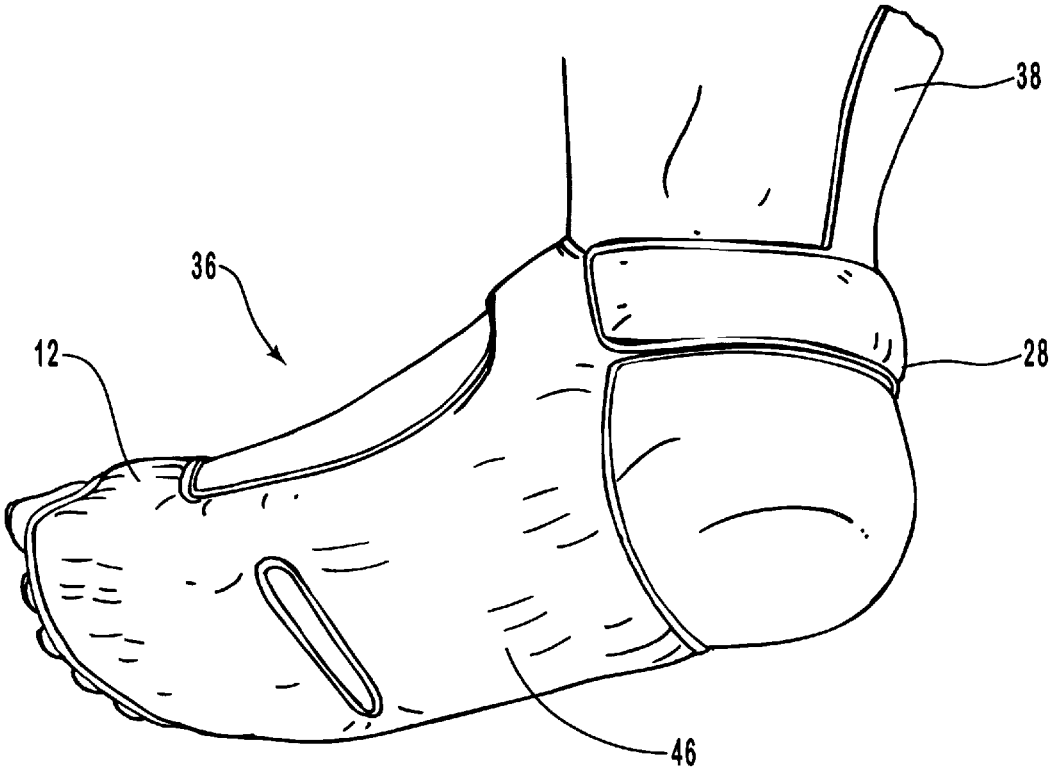
FIG. 4 is another view of a foot compression portion of one embodiment of the present invention.

Referring now to FIGS. 3 and 4, the details of foot compression portion 36 and the compressive forces applied by foot compression portion 36 are presented. As previously described, embodiments within the scope of this invention may comprise compressive means for applying a compressive force to selected portions of the foot. Also as previously described for foot compression portion 36, such compressive means may comprise, but are not limited to, an inflatable bladder such as inflatable bladder 46 of FIGS. 3 and 4. Inflatable bladder 46 may be adapted to apply various types of compressive forces. This section will explain the various types of compressive forces of the present invention and illustrate where they may be applied.

In one preferred embodiment of the present inventions, inflatable bladder 46 is not in fluid communication with inflatable bladder 32. By keeping the two bladders separate and distinct, calf compression portion 34 can be more easily severed from foot compression portion 36 and used separately.

Embodiments within the scope of this invention may be adapted to apply an upward compressive force to the sole of the foot from in front of the heel and extending past the ball of the foot under the phalanges. The structure of one embodiment designed to apply such a force is best illustrated in FIG. 4. As illustrated therein, inflatable bladder 46 extends from just in front of the heel to past the bottom of the foot and under the phalanges. A bladder in this portion of the foot will apply an upward compressive force to the sole of the foot. This upward compressive force mimics the compressive force given to the bottom of the foot when an individual walks. Prior art devices have applied compressive forces to a portion of the bottom of the foot. However, such prior art devices have been limited to compressive forces between the ball of the foot and the heel of the foot. In the present invention, the compressive force extends past the ball of the foot under the phalanges. This allows the compressive force to more closely mimic the compressive force exerted on a foot when an individual walks.

Embodiments within the scope of this invention may also be adapted to exert a downward compressive force in front of the tarsal region of the foot. As previously described, the phrase "in front of the tarsal region of the foot" includes that region of the foot distal of the cuneiforms (first cuneiform 18, second cuneiform 20, and third cuneiform 22 of FIG. 5). Such a compressive force may be generated, for example, by extending inflatable bladder 46 across the region covered by strap 14. This is perhaps best illustrated in FIG. 3. As previously described, the inflatable bladder may be enclosed within retaining structure 12. A portion of inflatable bladder 46 may thus extend inside strap 14 in order to exert a downward compressive force in front of the tarsal region of the foot.

Embodiments within the scope of this invention may also be adapted to apply a downward compressive force in the upper tarsal region of the foot. The "upper tarsal region" of the foot as used herein includes the region proximal of the cuneiforms (18, 20, and 22 of FIG. 5). Thus, a strap extending across the upper cuboid (26 of FIG. 5) and the navicular (24 of FIG. 5) may exert a downward compressive force in the upper tarsal region if an inflatable bladder is enclosed therein. Inflatable bladder 46 may therefore extend underneath strap 16 of FIG. 3 in order to exert a downward compressive force as just described.

Embodiments within the scope of this invention may also be adapted to exert a compressive force on at least one of either side of the ankle anywhere in a region bounded essentially by the posterior portion of the calcaneus, the medial or lateral malleolus, the Achilles tendon, and the posterior portion of the navicular. This region may be identified by referring to FIG. 5. In FIG. 5, the region enclosed by dashed line 48 is bounded essentially by the posterior portion of the calcaneus 50, the achilles tendon 52, the medial malleolus 54, and the posterior portion of the navicular 24. In FIGS. 3 and 4, strap 28 extends around the back of the ankle and covers at least a portion of this region. A compressive force may be applied to at least a portion of this region by extending bladder 46 under strap 28. Extending bladder 46 in this manner will cause a compressive force to be exerted on both sides of the ankle. A compressive force may be exerted on only one side by appropriately tailoring the extent of inflatable bladder 46 or by designing a different bladder configuration andretaining structure.

Although the above discussion has been described with respect to a single inflatable bladder covering all regions where compressive forces are desired, it would also be possible to utilize separate bladders in order to allow separate compressive forces to be exerted only where desired. For example, embodiments within the scope of this invention may comprise bladders that exert either all of the compressive forces previously described, or various combinations of the compressive forces, or a single compressive force.

Embodiments of the present invention may be adapted to be incapable of applying a downward compressive force to the midtarsal region. As previously described, applying a downward compressive force to the midtarsal region may adversely affect certain sensitive patient groups. For example, in the case of patients with diabetes, a downward compressive force in this region may lead to tissue damage. The embodiments illustrated in FIGS. 1 through 4 illustrate an open region above the midtarsal region of the foot. Leaving this region open prohibits the present invention from generating a downward compressive force in the midtarsal region. Furthermore, several benefits are achieved that are not available in the prior art. For example, several observations can be made of the skin and underlying structures in the area exposed by the window. First, the health of the skin tissue can be assessed by looking at skin color and texture. Second, skin blood flow can be assessed by applying sensors such as a laser Doppler flux probe or a photo plethysmograph probe. Third, an underlying artery can be palpated for pulsality by hand or by using an electronic monitor incorporating a strain sensitive element or continuous wave ultrasonic Doppler probe that is placed on the skin over the artery. All of these features can help a physician assess the effectiveness of a treatment regime using the present invention to increase vascular blood flow. The physician can then tailor the treatment regime to achieve the greatest benefit while minimizing any undesirable effects.

If the compressive means for applying a compressive force to selected portions of the foot comprises an inflatable bladder, such as inflatable bladder 46, then embodiments within the scope of the invention may comprise filling means for filling the bladder with a fluid from a fluid source. In the embodiment illustrated in FIG. 3, such filling means can comprise, for example, fitting 56. Fitting 56 may be a large bore fitting in order to allow rapid inflation and deflation of the foot compression portion.

The inflation, deflation, and delay rate as well as the pressure for foot inflation portion 36 and calf inflation portion 34 are adjustable. When inflating both the foot and calf portion, an inflation delay time between the start of inflation for each portion can be used and adjusted from zero seconds (for simultaneous inflation) to about two or more seconds (for progressive inflation). In one embodiment, the bladders are rapidly inflated and held at the preselected inflation pressure for between about two seconds to about eighteen seconds. The inflation pressure can range between about 50 mmHg to about 150 mmHg. The bladders may then be rapidly deflated in order to reach a pressure of between about 0 mmHg to about 10 mmHg and held at that pressure for between about 6 seconds to about 22 seconds. When progressive inflation is used, the foot portion may be inflated first with the calf portion being inflated at some time later. When used together, the inflation time, deflation time, and pressure for both the foot portion and the calf portion may be the same, or they may be different to tailor the treatment regime to the individual patient. Since the inflatable bladders of the foot portion and the calf portion are separate, when the foot portion and calf portion are used together, separate inflation tubes are preferably provided to the foot portion and the calf portion. This allows either simultaneous or progressive inflation.

The present invention accommodates treatment of deep vein thrombosis through rapid compression of areas of the foot, ankle, and calf. The invention inflation rate, inflation delay time, peak pressure, and cycle time can be adjusted to provide a rapid compression that creates high blood velocities and moves large blood volumes. This may provide the patient with a more effective prophylaxis against deep vein thrombosis.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed as desired to be secured by United States Letters Patent is:

1. A device for improving vascular blood flow in the lower extremities of a patient, the device comprising:

(a) compressing means for applying a compressive force to selected portions of a foot of the patient, the compressing means being adapted to apply:

(i) an upward compressive force to the sole of the foot from in front of the heel and extending under a substantial portion of the phalanges; and (ii) a downward compressive force to the dorsal side of at least a portion of the phalanges; and (b) retaining means for retaining the device against the foot, wherein the compressing means and retaining means are configured so that a dorsal region of the foot extending from the distal portion of the cuneiforms to the distal quarter of the metatarsals is open to allow visual monitoring thereof, and wherein the compressing means is incapable of applying a downward compressive force in the open dorsal region.

2. The device of claim 1, wherein the compressing means is further adapted to apply a compressive force around the Achilles tendon in at least a portion of a region extending from the calcaneus to the medial or lateral malleolus.

3. The device of claim 1, wherein the compressing means is further adapted to apply a downward compressive force to the upper tarsal region of the foot.

4. The device of claim 1, wherein the compressing means is further adapted to apply a compressive force to the dorsal side of a calf of the patient.

5. The device of claim 1, wherein the compressing means comprises a bladder that expands to exert a compressive force when a fluid is placed therein.

6. A device for improving vascular blood flow in the lower extremities of a patient, the device comprising:

(a) compressing means for applying a compressive force to selected portions of a foot and ankle of the patient, the compressing means being adapted to apply:

(i) an upward compressive force to the sole of the foot from in front of the heel and extending under a substantial portion of the phalanges;

(ii) a downward compressive force to the dorsal side of at least a portion of the phalanges; and (iii) a compressive force around the Achilles tendon in at least a portion of a region extending from the calcaneus to the medial or lateral malleolus; and (b) retaining means for retaining the device against the foot, wherein the compressing means and retaining means are configured so that a dorsal region of the foot extending from the distal portion of the cuneiforms to the distal quarter of the metatarsals is open to allow visual monitoring thereof, and wherein the compressing means is incapable of applying a downward compressive force in the open dorsal region.

7. The device of claim 6, wherein the compressing means is further adapted to apply a downward compressive force to the upper tarsal region of the foot.

8. The device of claim 6, wherein the compressing means is further adapted to apply a compressive force to the dorsal side of a calf of the patient.

9. The device of claim 6, wherein the compressing means comprises a bladder that expands to exert a compressive force when a fluid is placed therein.

10. A device for improving vascular blood flow in the lower extremities of a patient, the device comprising:

(a) first compressing means for applying a compressive force to selected portions of a foot of the patient, the first compressing means being adapted to apply:

(i) an upward compressive force to the sole of the foot from in front of the heel and extending under a substantial portion of the phalanges; and (ii) a downward compressive force to the dorsal side of at least a portion of the phalanges;

(b) first retaining means for retaining the first compressing means against the foot, wherein the first compressing means and first retaining means are configured so that a dorsal region of the foot extending from the distal portion of the cuneiforms to the distal quarter of the metatarsals is open to allow visual monitoring thereof, and wherein the first compressing means is incapable of applying a downward compressive force in the open dorsal region;

(c) second compressing means for applying a compressive force to at least a portion of the dorsal side of the calf of the patient; and (d) second retaining means for retaining the second compressing means against the calf.

11. The device of claim 10, wherein the first compressing means is further adapted to apply a downward compressive force to the upper tarsal region of the foot.

12. The device of claim 10, wherein the first compressing means is further adapted to apply a compressive force around the Achilles tendon in at least a portion of a region extending from the calcaneus to the medial or lateral malleolus.

13. The device of claim 10, wherein the first compressing means comprises a first bladder that expands to exert a compressive force when a fluid is placed therein, and the second compressing means comprises a second bladder that expands to exert a compressive force when a fluid is placed therein.

14. A device for improving vascular blood flow in the lower extremities of a patient, the device comprising:

(a) first compressing means for applying a compressive force to selected portions of a foot of the patient, the first compressing means being adapted to apply:

(i) an upward compressive force to the sole of the foot from in front of the heel and extending under a substantial portion of the phalanges;

(ii) a downward compressive force to the dorsal side of at least a portion of the phalanges; and (iii) a compressive force around the Achilles tendon in at least a portion of a region extending from the calcaneus to the medial or lateral malleolus;

(b) first retaining means for retaining the first compressing means against the foot, wherein the first compressing means and first retaining means are configured so that a dorsal region of the foot extending from the distal portion of the cuneiforms to the distal quarter of the metatarsals is open to allow visual monitoring thereof, and wherein the first compressing means is incapable of applying a downward compressive force in the open dorsal region;

(c) second compressing means for applying a compressive force to at least a portion of the dorsal side of the calf of the patient; and (d) second retaining means for retaining the second compressing means against the calf.

15. The device of claim 14, wherein the first compressing means is further adapted to apply an upward compressive force to the sole of the foot from in front of the heel and extending under a substantial portion of the phalanges.

16. The device of claim 14, wherein the first compressing means is further adapted to apply a downward compressive force to the dorsal side of at least a portion of the phalanges.

17. The device of claim 14, wherein the first compressing means is further adapted to apply a downward compressive force in the upper tarsal region of the foot.

18. The device of claim 14, wherein the first and second retaining means can be separated so that the second compressing means can be applied apart from the first compressing means.

19. A device for improving vascular blood flow in the lower extremities of a patient, the device comprising:

(a) a foot compression portion comprising a bladder adapted to receive a fluid to apply compressive forces to selected portions of a foot and an ankle of the patient, and a retaining structure enclosing the bladder and retaining the bladder against the foot and ankle, the compressive forces including:

(i) an upward compressive force to the sole of the foot from in front of the heel and extending under a substantial portion of the phalanges;

(ii) a downward compressive force to the dorsal side of at least a portion of the phalanges;

(iii) a downward compressive force in the upper tarsal region; and (iv) a compressive force around the Achilles tendon in at least a portion of a region extending from the calcaneus to the medial or lateral malleolus, wherein the foot compression portion is configured so that a dorsal region of the foot extending from the distal portion of the cuneiforms to the distal quarter of the metatarsals is open to allow visual monitoring thereof, and wherein the foot compression portion is incapable of applying a downward compressive force in the open dorsal region; and (b) a calf compression portion comprising a bladder adapted to receive a fluid to apply a compressive force to the dorsal side of the calf and a retaining structure enclosing the bladder and retaining the bladder against the calf.

20. The device of claim 19, wherein the foot compression portion is attached to he calf compression portion so that the foot compression portion and the calf compression portion can be applied to the patient together.

21. The device of claim 20, wherein the foot compression portion can be detached from the calf compression portion so that the calf compression portion can be applied separately to the patient.

22. The device of claim 19, wherein the calf compression portion is adapted so that the compressive force applied to the dorsal side of the calf is strongest in a region of the calf distal from the heart and progressively weaker in regions of the calf more proximal to the heart so that blood is pushed upward toward the heart of the patient.

* * * * *

UNITED STATES PATENT AND TRADEMARK OFFICE

CERTIFICATE OF CORRECTION

PATENT NO. : 6,129,688
DATED : October 10, 2000
INVENTOR(S) : Ed Arkans

It is certified that error appears in the above-identified patent and that said Letters Patent is hereby corrected as shown below:

Column 4,
Line 41, after "that these" change "drawing" to -- drawings --

Column 6,
Line 39, before "filling means" change "comprises" to -- comprise --

Column 8,
Line 21, after "bladder configuration" change "andretaining" to -- and retaining --

Column 12,
Line 36, before "calf compression" change "he" to -- the --

Signed and Sealed this

Eighteenth Day of December, 2001

*Attest:*

*Attesting Officer*

JAMES E. ROGAN
*Director of the United States Patent and Trademark Office*